US006786286B1

(12) United States Patent
Bartlett

(10) Patent No.: US 6,786,286 B1
(45) Date of Patent: Sep. 7, 2004

(54) FIRE COMBATING SYSTEM AND METHOD

(75) Inventor: John B. Bartlett, Jupiter, FL (US)

(73) Assignee: Barricade International, Inc., Hobe Sound, FL (US)

( * ) Notice: Subject to any disclaimer, the term of this patent is extended or adjusted under 35 U.S.C. 154(b) by 0 days.

(21) Appl. No.: 10/118,301

(22) Filed: Apr. 8, 2002

Related U.S. Application Data

(62) Division of application No. 09/567,624, filed on May 9, 2000, now Pat. No. 6,386,293.

(51) Int. Cl.[7] ..... A62C 35/00

(52) U.S. Cl. ..... 169/14; 169/5; 169/15; 169/16; 169/37; 169/DIG. 2; 239/310; 239/323; 239/424; 239/209; 239/450

(58) Field of Search ..... 169/5, 13, 14, 169/15, 16, 37, DIG. 2; 239/208, 209, 310, 318, 303, 304, 323, 328, 407, 408, 418, 419, 423, 424, 450; 252/2, 3, 4, 8.05

(56) References Cited

U.S. PATENT DOCUMENTS

| | | | | | |
|---|---|---|---|---|---|
| 561,483 | A | | 6/1896 | Bryce | |
| 679,504 | A | | 7/1901 | Heard | |
| 3,645,337 | A | * | 2/1972 | Livingston | 169/14 |
| 3,647,001 | A | | 3/1972 | Livingston | |
| 3,779,317 | A | * | 12/1973 | Livingston | 169/5 |
| 3,833,062 | A | * | 9/1974 | Livingston | 169/15 |
| 3,884,305 | A | | 5/1975 | Livingston | |
| 3,903,968 | A | * | 9/1975 | Livingston | 169/14 |
| 5,137,094 | A | | 8/1992 | Broussard | |
| 5,330,105 | A | | 7/1994 | Kaylor | |
| 5,332,524 | A | | 7/1994 | Kaylor | |
| 5,445,226 | A | | 8/1995 | Scott et al. | |
| 5,494,112 | A | | 2/1996 | Arvidson et al. | |
| 5,779,158 | A | | 7/1998 | Baker | |
| 5,849,210 | A | | 12/1998 | Pascente et al. | |
| 5,960,887 | A | | 10/1999 | Crabtree | |

* cited by examiner

*Primary Examiner*—Steven J. Ganey
(74) *Attorney, Agent, or Firm*—Hunton & Williams LLP

(57) ABSTRACT

A reservoir of super absorbent polymers which can be independently pressurized, remotely stored and a supply of water which is admixed with the SAP at a point closely adjacent of an adjustable nozzle. In one embodiment the system involves a home unit with a portable hand carried reservoir which can be pressurized. Yet another system involves a back pack carried by a homeowner or firefighter for spraying which can be pressurized. Yet another embodiment involves a reservoir which can be independently pressurized with a pump so that any reduction in the water pressure in a tap line can be overcome by the SAP auxiliary pressure delivery. Other embodiments relate to a portable unit containing both the water reservoir and the SAP reservoir to the end that it is self-contained, and the admixing can be a function of wherever the homeowner, firefighter or rescue person should don the equipment. Another embodiment relates to the utilization with pre-existing fire extinguishing equipment, normally positioned by municipality at airports and other areas where firefighting equipment is found on a permanently stationed basis. A further embodiment relates to a retrofit of a sprinkler system such as in warehouses, factories, hotels, and the like to use admixed SAP.

7 Claims, 7 Drawing Sheets

FIRE COMBATING SYSTEM AND METHOD

RELATED APPLICATION

This Application is a Divisional of allowed patent application Ser.No. 09/567,624, filed May 9, 2000, now U.S. Pat. No. 6,386,293.

FIELD OF THE INVENTION

The present invention relates to equipment and chemicals, and more specifically to a method for delivering a concentrated fire retardant solution to either protect the surface from fire, or extinguish the fire when it has begun. The system finds its maximum utility with super absorbent polymers (hereinafter SAP) such as are used to absorb moisture in diapers. The basics of the invention are disclosed in European Patent EP 0 774 279 A1, Pascente et al. U.S. Pat. No. 5,849,210 and Brückner European Patent No. 0 649 669 A1 based upon German Patent.

BACKGROUND OF THE INVENTION

Pressure assemblies, hand operated pumps, are well known as garden spraying and other spraying activity. Exemplary are U.S. Pat. Nos. 4,984,742; 5,064,170; 5,301,877 and 5,307,995, all assigned to Corporation. However, such pumps and sprayers are normally involved in dispensing a fluid with a relatively low viscosity comparable to ordinary tap water. With the super absorbent polymers in use with the present invention, such sprayers are vulnerable to clogging, reduced tap water pressures, and other unanticipated sources of interruption. Moreover, with just an ordinary garden hose type nozzle, the spray patterns cannot be controlled with the position desired by firefighters, particularly when combating tenacious fires such as observed at tire dumps when several used tires begin to burn. Furthermore, what is also needed is a system which has a wide variety of applications utilizing tap water and a separate reservoir of the SAP, utilizing carried water with a separate reservoir of SAPs, operating with commercial type fire extinguishing equipment, and indeed in conjunction with sprinkler systems of the type used in warehouses factories, and office buildings and large apartment buildings. The subject SAPs, if combined with water, swell and rapidly clog containers and lines. Hence, it is desirable to deliver the SAP to the water at a point as close to the application as practicable.

SUMMARY OF THE INVENTION

The present invention involves primarily utilizing a reservoir of super absorbent polymers which can be independently pressurized, remotely stored and a supply of water which is admixed with the SAP at a point closely adjacent of the adjustable nozzle. Invariably an eductor or mixer couples the flow of water with the flow of SAP at a point within easy deliver range of the nozzle for admixing the SAP concentrate, which, when it comes in contact with water, begins to swell at a rapid rate prior to leaving the nozzle at which time it is directed to the fire to be controlled or the combustible substance to be sprayed for protection against an impending contact with flames in an existing fire. In one embodiment the system involves a home unit with a portable hand carried reservoir. Yet another system involves a back pack carried by a homeowner or firefighter for spraying. Yet another embodiment involves a reservoir which can be independently pressurized with a pump so that any reduction in the water pressure in a tap line can be overcome by the SAP auxiliary pressure delivery. Other embodiments relate to a portable unit containing both the water reservoir and the SAP reservoir to the end that it is self-contained, and the admixing can be a function of wherever the homeowner, firefighter or rescue person should don the equipment. Another embodiment relates to the utilization with preexisting fire extinguishing equipment, normally positioned by municipality at airports and other areas where firefighting equipment is found on a permanently stationed basis. A final embodiment relates to a retrofit of a sprinkler system such as in warehouses, factories, hotels, and the like.

In view of the foregoing, it is a principal object of the present invention to provide a system for dispensing SAP at a fire site which is adaptable to portability, modified portability in conjunction with a pre-existing water system, and utilization with firefighting equipment in ready form which is cost effective and in many adaptations, highly portable.

A further object of the present invention is to provide such firefighting portable equipment which is compact, light weight and easy for the firefighter to carry in addition to the breathing equipment which he must also carry.

Yet another object of a present invention is to provide a retrofit to pre-existing sprinkler systems which will add the advantage of spraying an SAP rather than just plain water which experience has shown will significantly enhance the fire extinguishing capability of a single sprinkler head or a plurality thereof in any given installation.

In addition, another advantage of the present invention is to provide for the storage of a concentrated SAP with a long shelf life, and which when activated will promptly dispense the SAP in an effective and efficient manner. A related object of the present invention is to achieve all of the above in a system, which, by selective application, can purge elements of SAP that might otherwise clog the system.

DESCRIPTION OF ILLUSTRATIVE DRAWINGS

Further objects and advantages of the present invention will become apparent as the following description of the illustrative drawings take place, in which:

FIG. 7 is an enlarged partially exploded view of the system shown in

Figure 11:
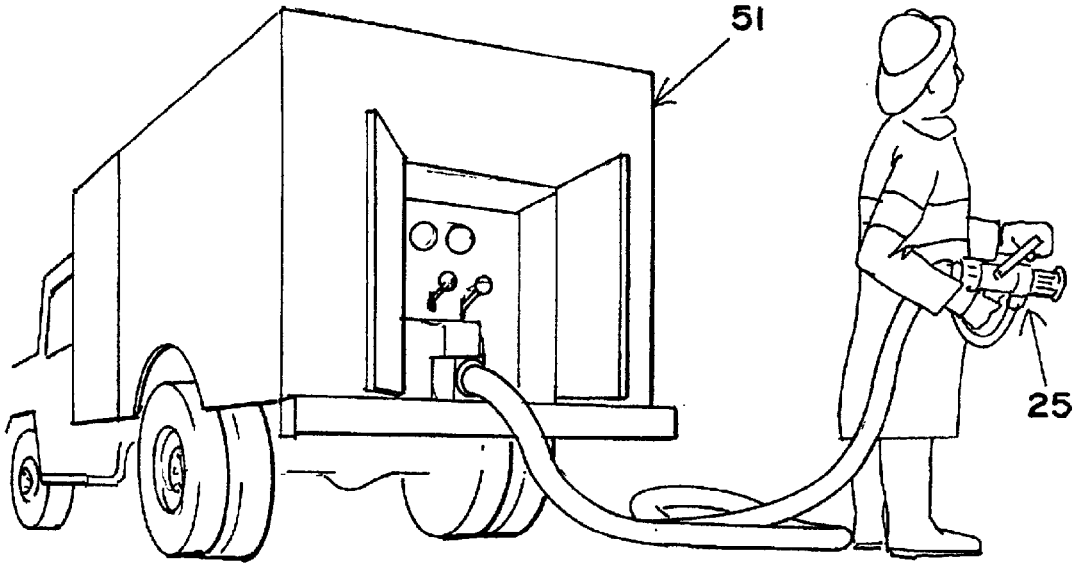
Figure 12:
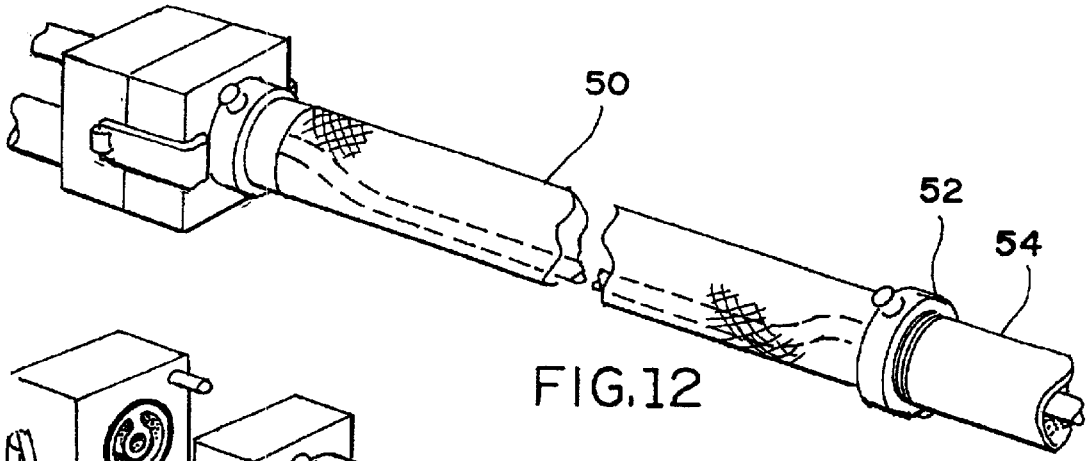
Figure 13:
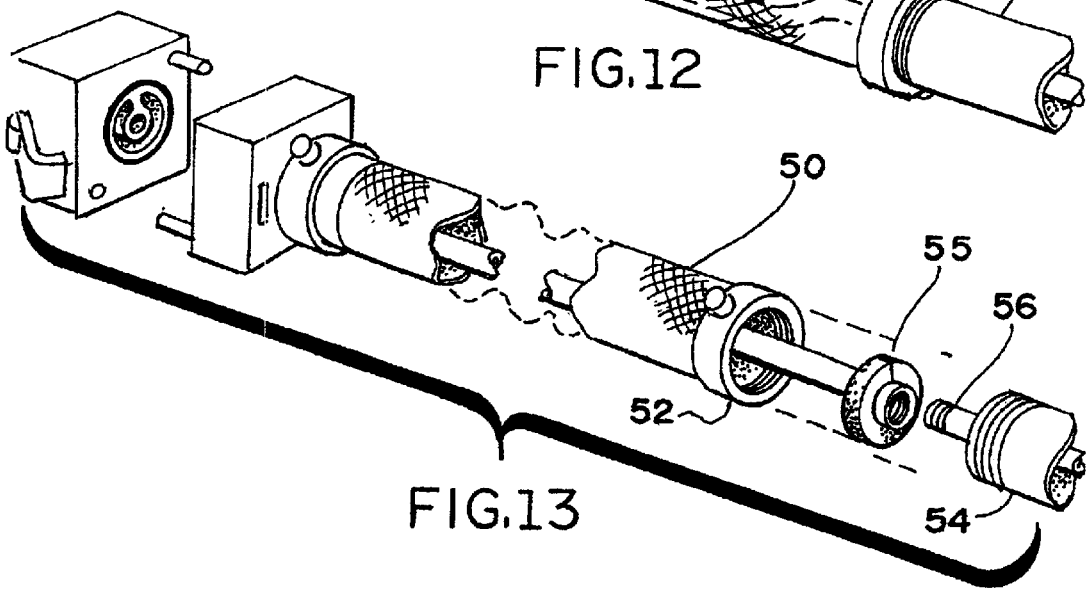
Figure 14:
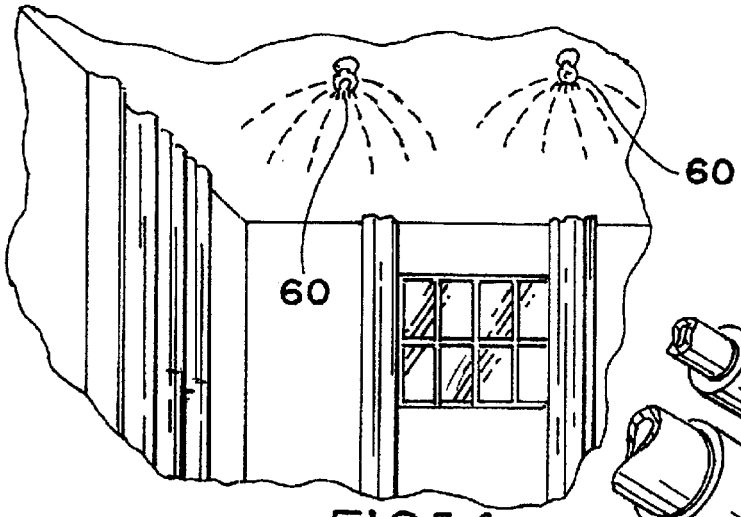
Figure 16:
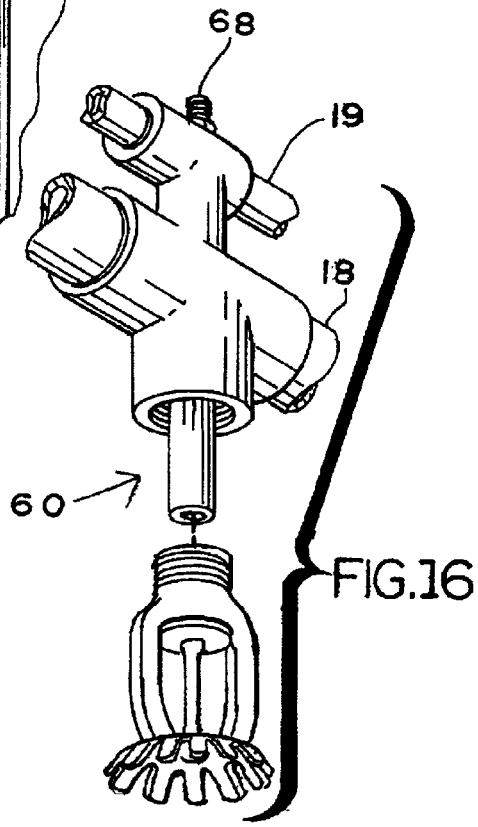
Figure 15:
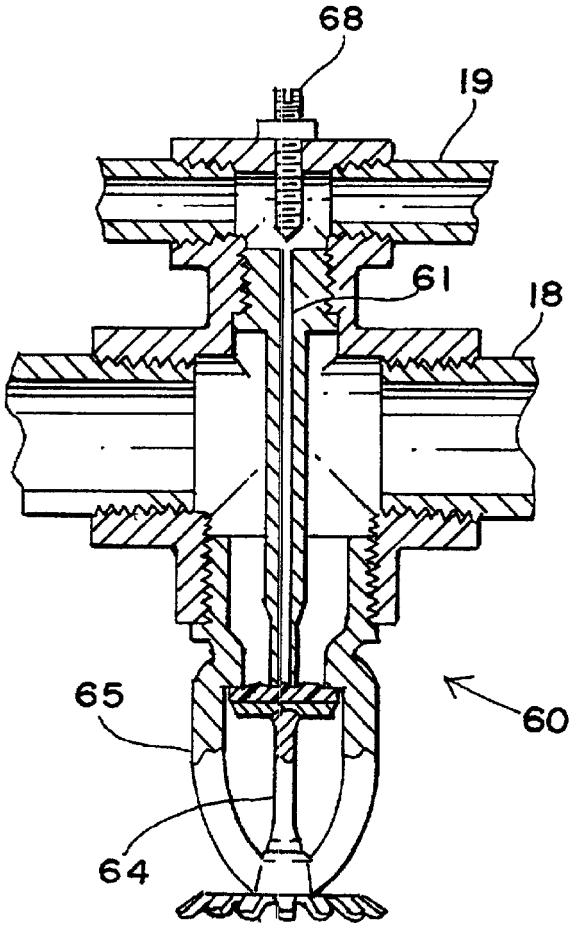

FIG. 11 has another embodiment showing a firefighter and a particular fire truck utilizing another embodiment of the present invention;

FIG. 12 is a partially cut-away view of the system utilized by the firefighter in FIG. 11 showing how the concentrate is carried interiorly of the flexible fire hose to a point where it can be co-mixed with the water a distance sufficiently close to the nozzle or point of application so that clogging or overexpansion of the SAP does not have sufficient dwell time to occur;

FIG. 13 is an exploded view of the showing in FIG. 12 taken from essentially the same vantage point and essentially the same scale;

FIG. 14 is a broken view of a corner of a dwelling in which two sprinkler heads are diagrammatically shown;

FIG. 15 is a longitudinal sectional view in enlarged scale of the sprinkler head modified to accommodate the SAP dispensing facility;

FIG. 16 is an exploded view of the sprinkler head shown in FIG. 14; and

Figure 17:
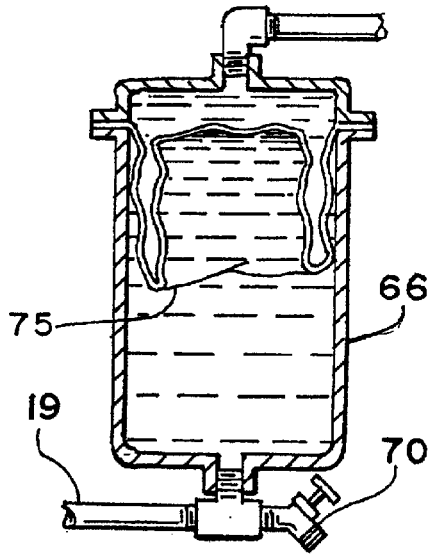

FIG. 17 is a partial diagrammatical view of a remote pressurized SAP dispenser for use when the water pressure has diminished to a point where additional pressure is required to maintain the desired concentration of SAP being dispensed into the area where the fire protecting and extinguishing characteristics are employed due to either the independent actuation of sprinkler heads, or the actuation by a low melt fuse.

FIRST EMBODIMENT OF THE INVENTION

The first embodiment of the present invention is shown in FIGS. 1, 2, 3, and 4. There it will be seen, as in FIG. 1, that the homeowner is carrying the valve eductor nozzle 10, and the pressure supply cylinder 11 in his right hand. A water hose 18 carries ordinary tap water to the valve eductor nozzle 10. As shown in greater deal in FIG. 2, the reservoir 11 which contains the SAP is pressurized by a hand pump 12. The concentrate hose carries the SAP from the reservoir 11 through the concentrate valve 16 into the eductor 15. At the far end of the eductor, a nozzle is provided which is adjustable.

In operation, the Venturi effect at the eductor 15 is normally adequate to withdraw the SAP from the pressure supply cylinder or reservoir 11. However, in the event water pressure is reduced, which often happens when a neighborhood is involved in a fire situation and several fire hydrants are tapped by firefighters, the homeowner need only activate the hand pressure pump 12 to continue an adequate supply of SAP for addition to the valve eductor and nozzle assembly 10. This also permits the homeowner to vary the pattern of application of the SAP in the event he wants to reach out a considerably longer distance, with a more narrowly confined spray.

SECOND EMBODIMENT OF THE INVENTION

Figure 3:
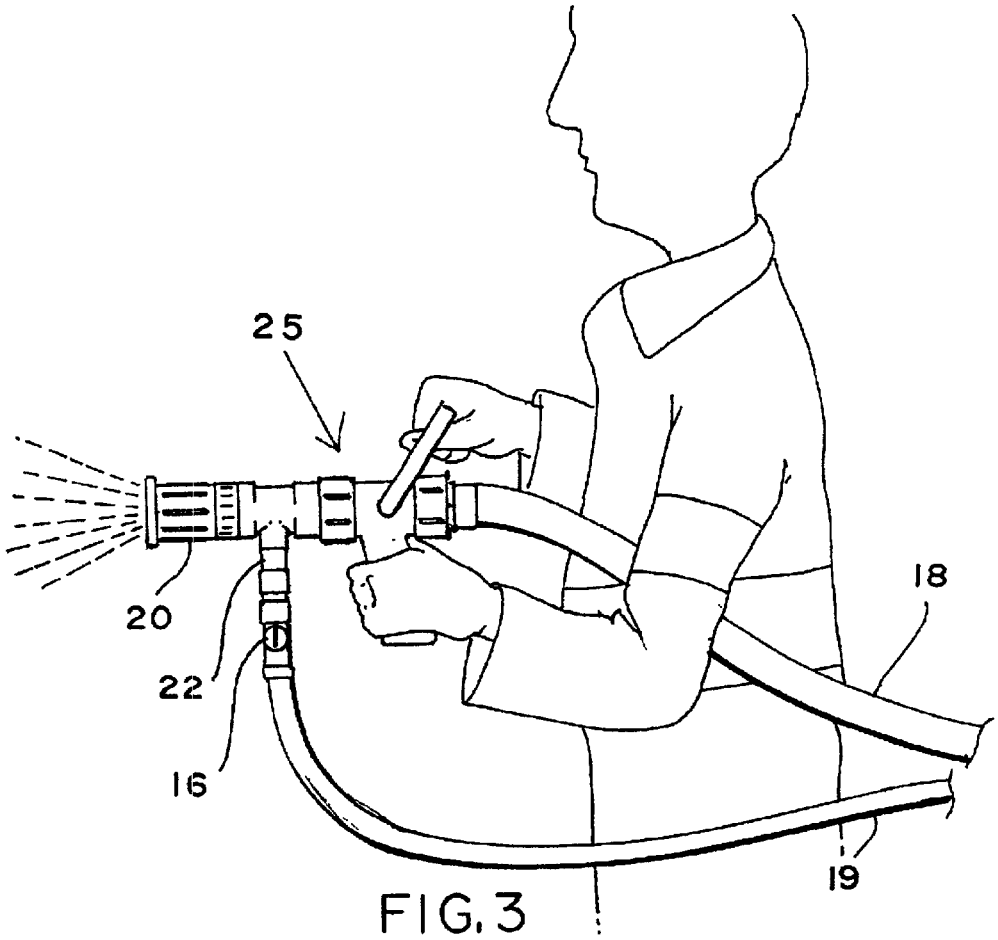
FIG. 3 is a front elevation of a user of the system as identified in FIGS. 1 and 2, but showing only the dispensing of the SAP and not the reservoir, whether the reservoir is pressurized or not.
Figure 4:
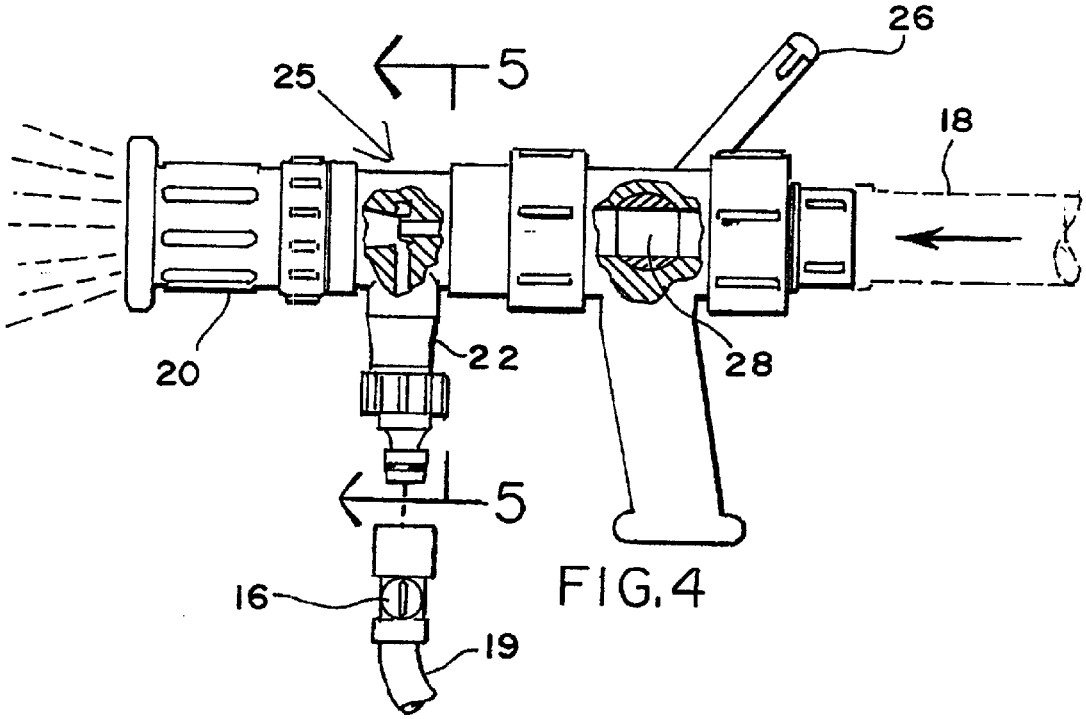
FIG. 4 is an enlarged exploded view of the inductor showing its connection to the tank.
Figure 5:
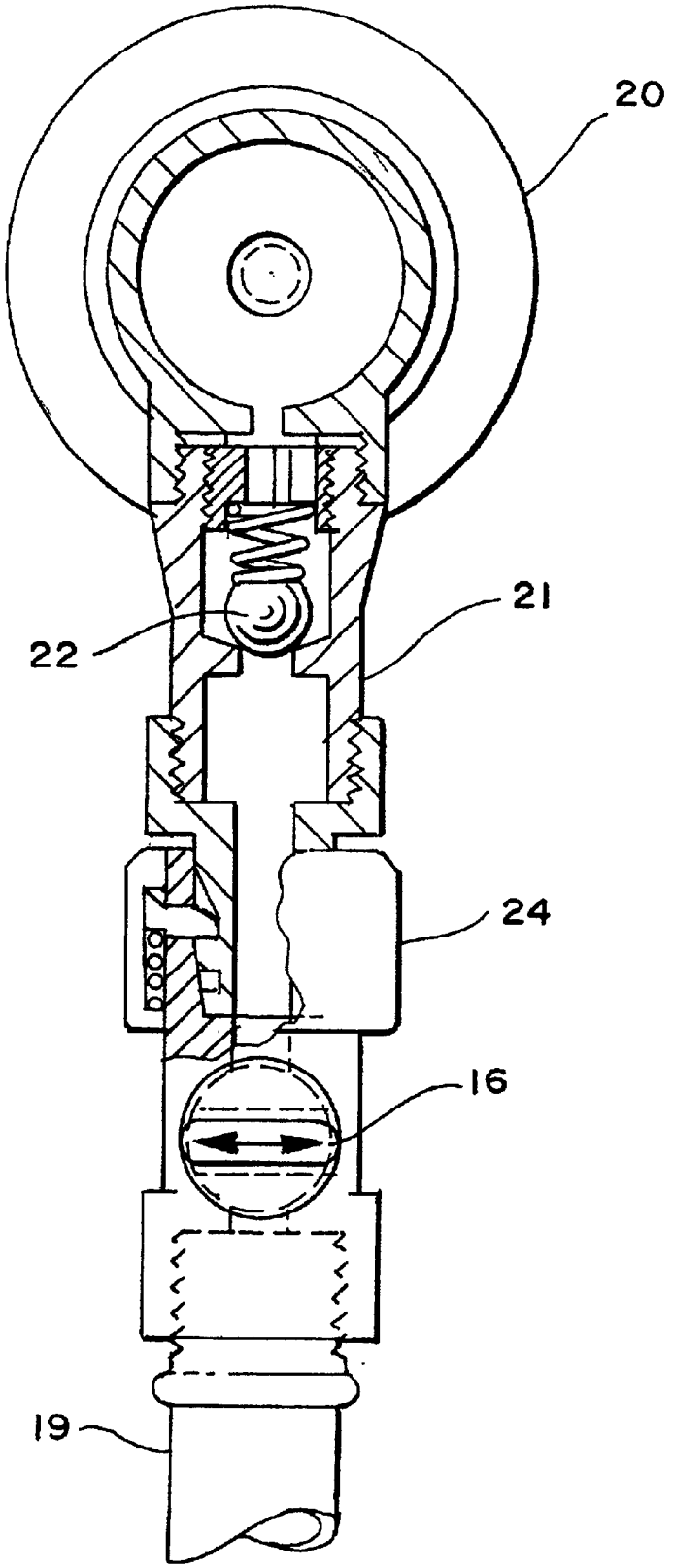
FIG. 5 is an enlarged longitudinal sectional view of the eductor portion of FIG. 4 taken along section line 5—5 of FIG. 4.

The second embodiment, as shown inn FIG. 3, can employ a water control assembly 25 to control the amount of SAP admixed fluid extending outwardly from the nozzle. As will be seen, particularly in FIGS. 4 and 5, the valve eductor nozzle assembly 10 is feed by an ordinary water hose 18 coming into the valve assembly which, by activating the handle 26, turns the sphere valve 28 to adjust the flow of water to the water hose from on to off, and various preselected positions in between. Also to be noted is a ball check 22 located immediately after the quick disconnect 24 for the SAP source. The ball check prevents tap water from going back into the reservoir, and conversely when the reservoir is pressured, assists in maintaining the pressure in the concentrate hose 19. FIG. 5 is an enlarged version of the sphere valve 28 shown in the right hand side of FIG. 4, illustrating how the rotation of the handle 26 rotates the sphere valve 28 to control the flow of water coming in through water hose 18.

THIRD EMBODIMENT OF THE INVENTION

Figure 6:
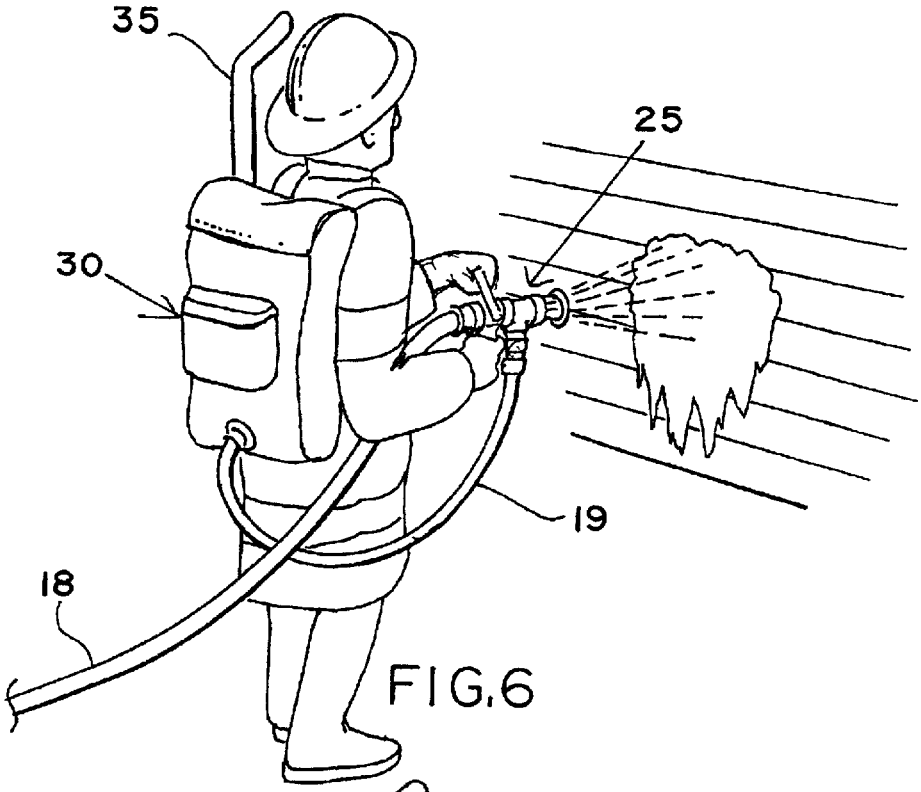
FIG. 6 is comparable to FIG. 1 but shows the system employed with the reservoir as a back pack, and the solution coming from a fixed pressure water source.
Figure 7:
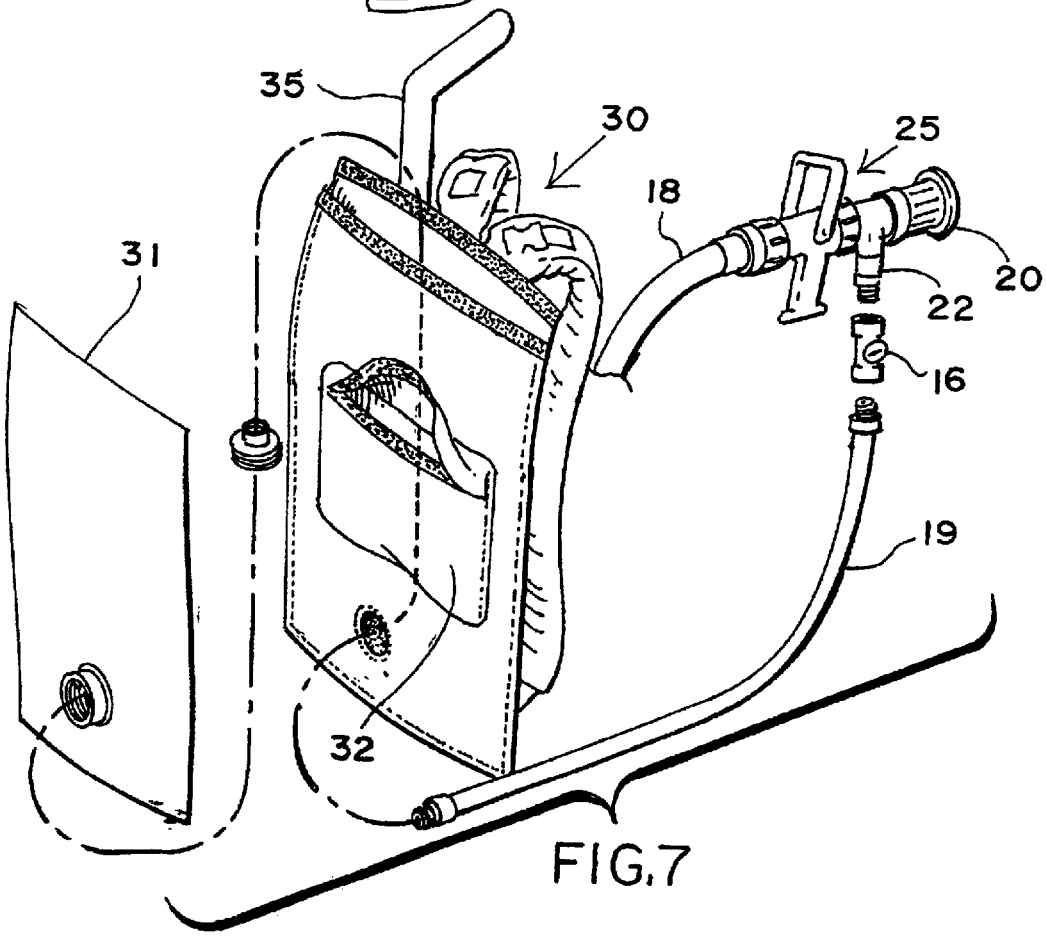

The third embodiment is shown in FIGS. 6 and 7 where it will be seen that the firefighter, whether amateur homeowner or professional, carries a back pack 30. The back pack 30 contains a liner 31 in which the concentrate is packaged. The balance of the back pack may contains a reservoir for water, but as shown, anticipates usage with an independent water system to a water hose 18. The advantage of the third embodiment shown in FIGS. 6 and 7 is that the concentrate can be pressurized by the operator by squeezing his back pack, or literally leaning against the wall and pressuring it so that a pressure is built up which, in turn, in held in place by means of the ball check 22. In this embodiment the pressurization can be affected by the applicator, whether a professional or homeowner, literally by leaning against the wall to squeeze the back pack to in turn pressurize the same.

FOURTH EMBODIMENT OF THE INVENTION

Figure 8:
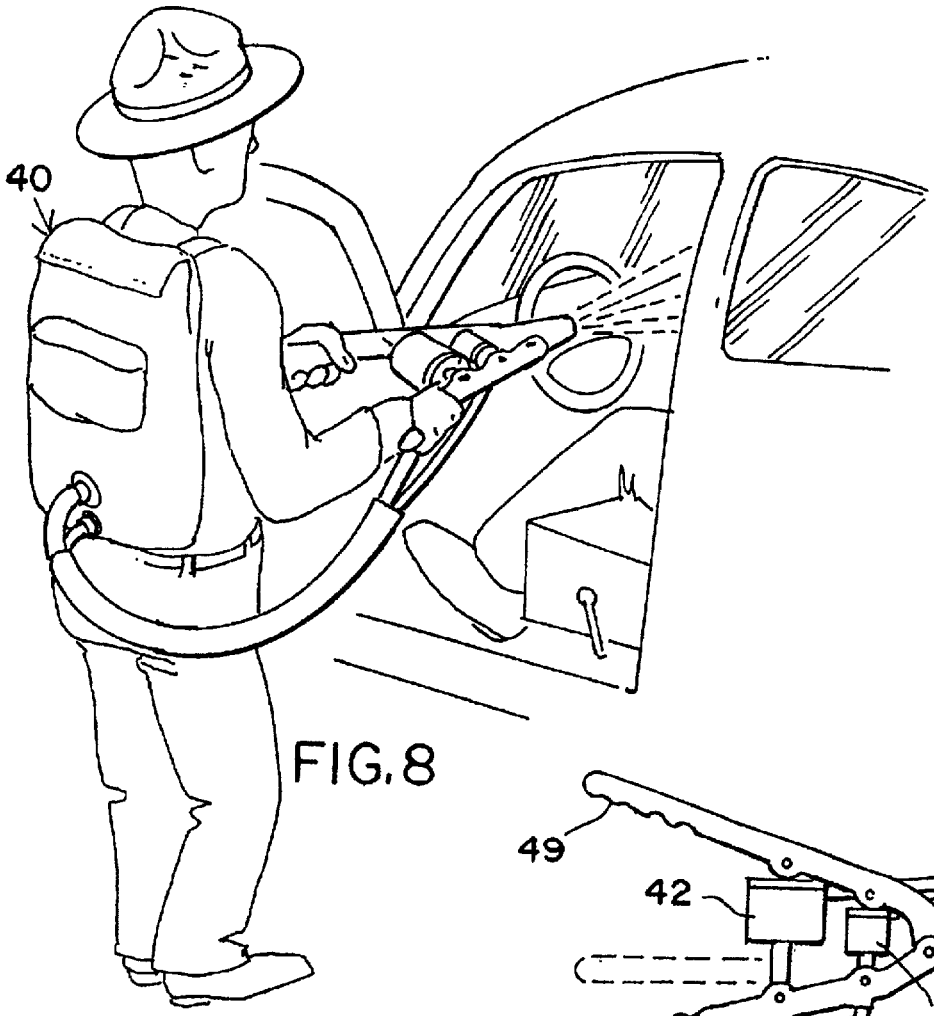
FIG. 8 is yet another embodiment in which the water and the SAP are contained in two segregated portions of a back pack and applied by means of a hand pump, which hand pump pressurized the water and the SAP separately.
Figure 10:
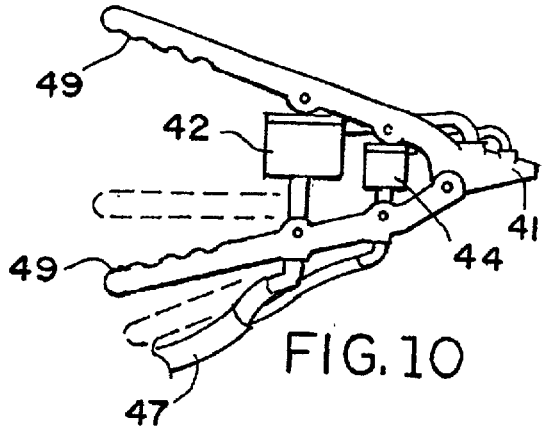
FIG. 10 is a plan view of the pump and dispensing assembly shown in both FIGS. 8 and 9.
Figure 9:
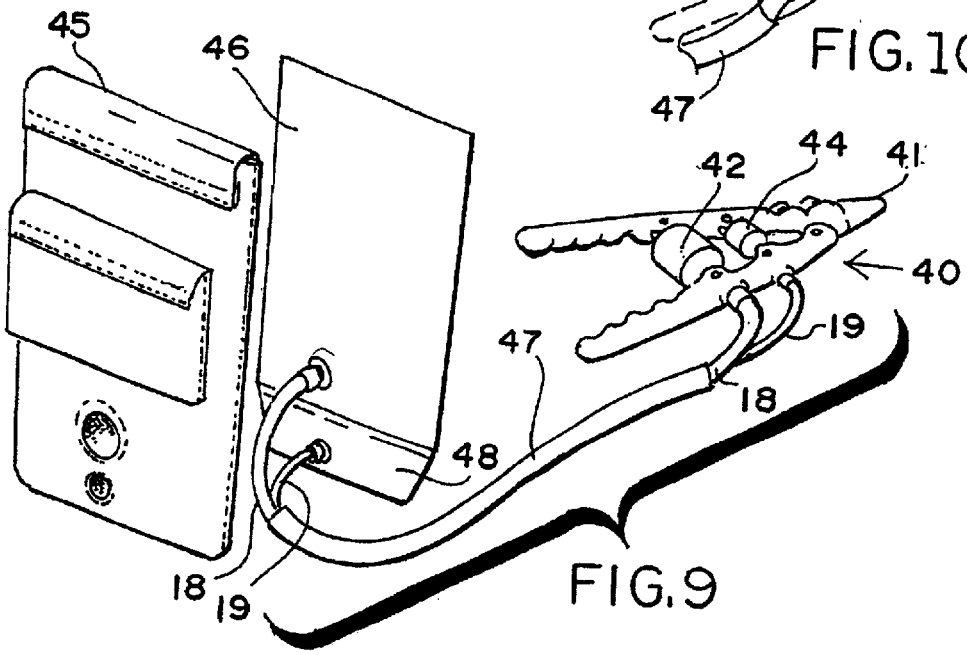
FIG. 9 is an exploded view of the assembly in FIG. 8 and in perspective.

The fourth embodiment of the present invention, shown in FIGS. 8, 9 and 10, is directed to a complete portable unit 40. The heart of the portable unit is a double-piston actuated hand pump eductor 41 utilizing a water pump portion 42 and an SAP portion pump 44. The back pack 45 contains both the water reservoir 46, here shown as five (5) gallons, and the SAP reservoir concentrate 48, in amount of a quart. Therefore the content weight approximately forty two (42) pounds with the equipment weighing another eight (8) pounds for a grand total of fifty (50) pounds carried by the operator. As will be seen, the SAP hose 19 and the water hose 18 are carried in a single sheath 47. Thus, in the fourth embodiment as shown in FIGS. 8, 9, and 10, the water and the SAP are all portable, and the pumping system is all manual. Nonetheless, the pressurization of the SAP in addition to the water lies at the heart of the embodiment.

As will be noted, the larger pump 42 exceeds the size of the smaller pump 44 by at least 5 fold. In addition, it will be seen that the lines carrying fluid from the larger pump 42 to the eductor 41 are arranged to be upstream from the line which carries the super absorbent polymer from the smaller pump 44 to the eductor 41. In this fashion, the proportioning of the ratio is undertaken primarily by the size of the pumps since adjustment in the field is purposely precluded by this unit to render it very simple in operation and predetermined in the amount of discharge. The handles 49 are brought together and pulled apart, which at the same time, pump the water and the super absorbent polymer in such a fashion that the water picks up the super absorbent polymer and directs the admixture to the point where combustion is being combated.

FIFTH EMBODIMENT OF THE INVENTION

The fifth fire truck retrofit embodiment, as shown in FIGS. 11, 12, and 13, differ in principle from the fourth embodiment primarily in that the SAP hose 19 is carried internally of the canvas fire hose 50 from the fire truck 51 to the point of approximate application.

Figure 1:
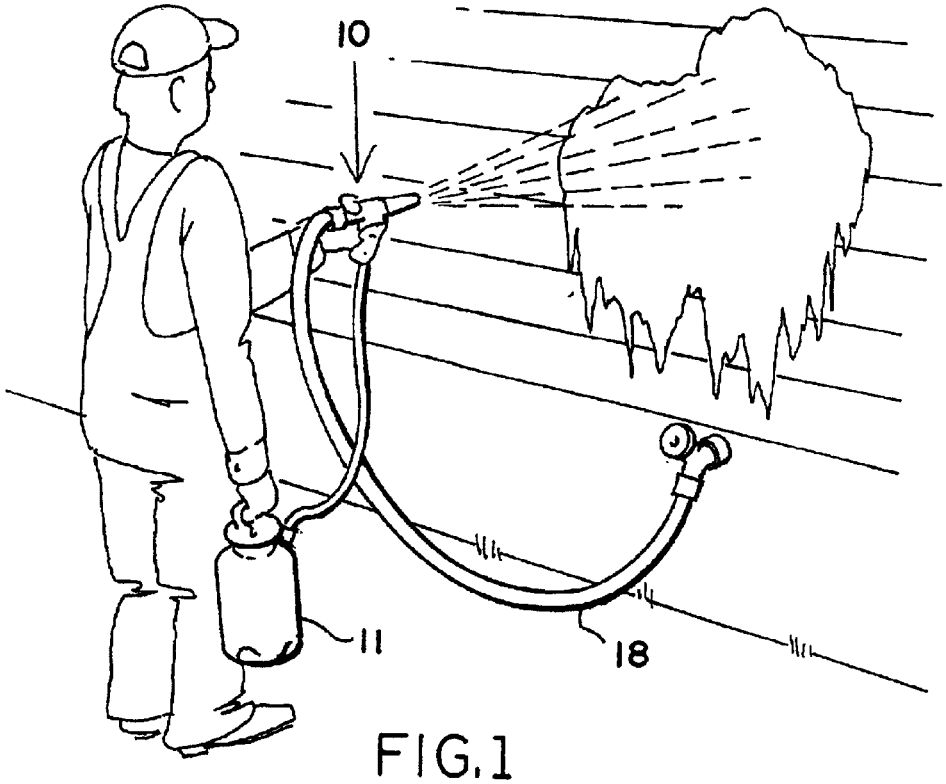
FIG. 1 is a partially diagrammatic picture of a simple home system which includes a valve, eductor, and nozzle in combination with a portable reservoir in the form of a pressure supply cylinder and coupled to a tap water outlet at a building structure.
Figure 2:
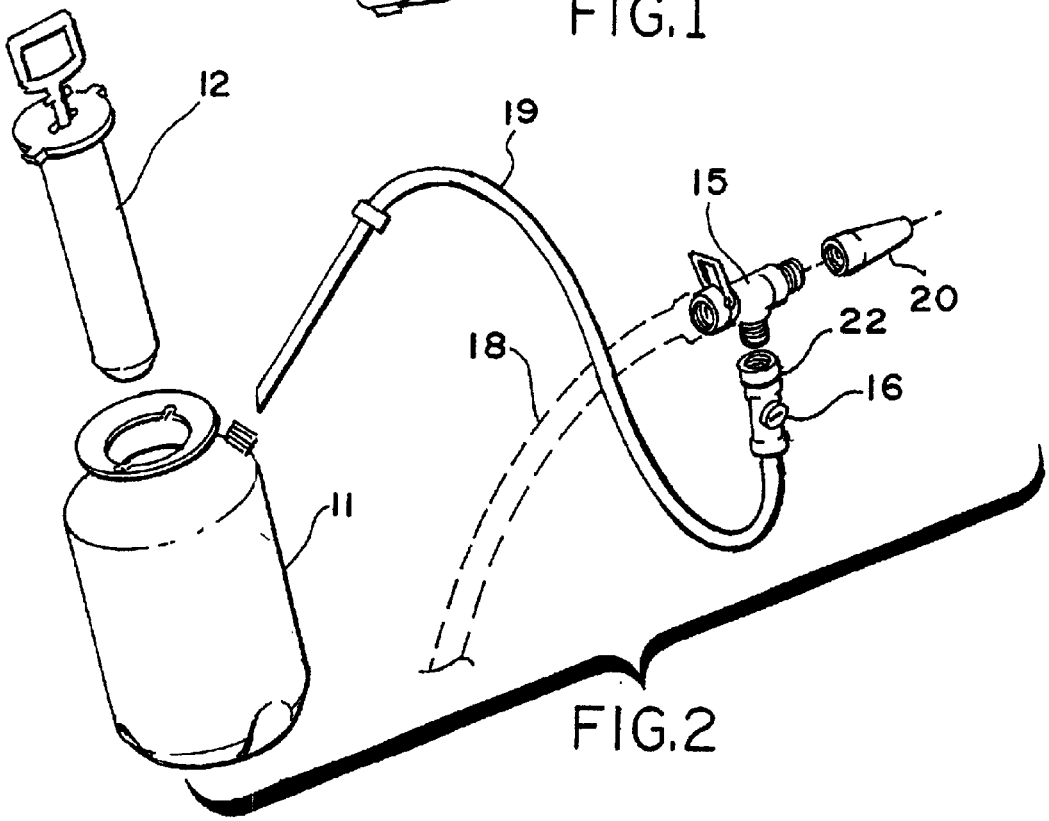
FIG. 2 is an enlarged partially exploded perspective view of the system illustrated in FIG. 1.

It will be appreciated that while the firefighter is shown close to the fire truck in FIG. 11, he may be employing a hose which is 200 to 300 feet long and the water is pressurized by the fire truck itself at 150 to 200 pounds. If the SAP is mixed with the water at the fire truck, it will expand significantly while transported through the hose 50 to the point of application. Accordingly, in this embodiment, the SAP is transported separately in a concentrate hose 19 which will co-extend the fire hose 50. Somewhere within the last 25 to 30 feet of the fire hose 50, the coupler 52, as shown in FIG. 13, is located. This then couples to the embedded SAP hose 19 in the extension length 54 of the entire fire hose system. Thereafter, the eductor valve assembly 25 of FIGS. 2, 3 and 6 is operated by the firefighter. The SAP is normally pressurized with a greater pressure than the water in the hose 50. After the system has been used with the fire truck, it is desirable to remove the concentrate hose from inside the fire hose. This is done by pulling it from the fire hose after which time it can be flushed and ready for further usage. When ready for usage, a "drag chute" 55 is secured to the end of the concentrate hose 19, and then the drag chute 55 inserted into the fire hose. Once the fire hose is pressurized with water, the water pressure against the drag chute 55 literally drags the concentrate hose to the point of attachment with the activator end 56 of the hose, where upon the coupler 52, as shown in FIG. 13, is secured to the SAP hose 19 in the applicator hose 50 and firefighting is undertaken.

SIXTH EMBODIMENT OF THE INVENTION

The sixth embodiment in a sprinkler system is illustrated diagrammatically in FIG. 14. More specifically, as shown in FIGS. 15 and 16, the concentrate hose 19 is positioned parallel to the main water hose 16. The sprinkler head 60 is then secured to a concentrate central delivery orifice 61 and is co-extensive with the water from the water pipe 18 when the fire fuse 64 is opened and the sprinkler head 60 is activated. The fuse length 64, as shown, can be formed of rose metal, or any other low temperature alloy which will hold the valve 65 in the closed position but when melted, permits the valve 65 to open and thereafter the water passes quickly from the water conduit coaxially around the orifice feed the SAP, and the same are mixed literally for the expansion of the SAP as the water propels the SAP to the area of predetermined contact. As shown in FIG. 17, a water pressure accumulator 66 can be optionally secured to the system in the event pressure is reduced.

A needle valve 68 is added to the top of the sprinkler head as shown in FIGS. 15 and 16 to fine tune the adjustment for each of the sprinkler heads based upon any line loss in pressure throughout the system. As shown in FIG. 17, the pressure accumulator 66 includes a flexible diaphragm 75 which separates the incoming flow of fire protection fluid in hose 19 from ordinary water pressure. The spigot 70 secured to the concentrate hose 19 to control the flow of the concentrate. Thus, the concentrate which is interior of the accumulator 66 is pressurized by-the water fluid secured at the top portion of the flexible diaphragm 75, as shown.

DESCRIPTION OF THE METHOD

It will be appreciated that a common element of the method applied in the five embodiments disclosed is the one of transporting the SAP to a point of admixture with the water with minimal exposure of the SAP to water prior to the actual admixing at a dispenser end. In the species of the method, independent pressurization is contemplated to be applied to the SAP in the event that its own pressurization system or the pressurization system of the water lower to the point the Venturi effect at the eductor (the pull effect) requires further support from an auxiliary force of pressure (the push effect). Also in the method, the concentrate hose may be parallel and strapped to the water hose, or coaxially inserted as with the fire truck application. In all embodiments it will be noted that the unsupported length of the concentrate hose is minimized whenever possible.

It will be understood that various changes in the details, materials and arrangements of parts, or method which have been herein described and illustrated in order to explain the nature of the invention, may be made by those skilled in the art within the principle and scope of the invention as expressed in the appended claims.

| PARTS LIST | |
|---|---|
| 00 | |
| 01 | |
| 02 | |
| 03 | |
| 04 | |
| 05 | |
| 06 | |
| 07 | |
| 08 | |
| 09 | |
| 10 | VALVE EDUCTOR NOZZLE |
| 11 | PRESSURE SUPPLY CYLINDER |
| 12 | HAND PUMP |
| 13 | |
| 14 | |
| 15 | EDUCTOR |
| 16 | CONCENTRATE VALVE |
| 17 | |
| 18 | WATER HOSE |
| 19 | CONCENTRATE HOSE |
| 20 | NOZZLE/ADJUSTABLE |
| 21 | CONCENTRATE HOSE COUPLER |
| 22 | BALL CHECK |
| 23 | |
| 24 | QUICK DISCONNECT |
| 25 | WATER CONTROL ASSEMBLY |
| 26 | HANDLE |
| 27 | |
| 28 | SPHERE VALVE |
| 29 | |
| 30 | BACK PACK |
| 31 | LINER |
| 32 | INSERT |
| 33 | |
| 34 | |
| 35 | HAND PUMP |
| 36 | |
| 37 | |
| 38 | |
| 39 | |
| 40 | PORTABLE UNIT |
| 41 | HAND PUMP EDUCTOR |
| 42 | WATER PUMP |
| 43 | |
| 44 | SAP PUMP |
| 45 | BACK PACK |
| 46 | WATER RESERVOIR |
| 47 | SHEATH |
| 48 | SAP RESERVOIR |
| 49 | HANDLES |
| 50 | CANVAS FIRE HOSE |
| 51 | FIRE TRUCK |
| 52 | COUPLER |
| 53 | |
| 54 | EXTENSION HOSE |
| 55 | DRAG CHUTE |
| 56 | ACTIVATOR END |

-continued

| PARTS LIST | |
|---|---|
| 57 | |
| 58 | |
| 59 | |
| 60 | SPRINKLER HEAD |
| 61 | ORIFICE |
| 62 | |
| 63 | |
| 64 | FIRE FUSE |
| 65 | VALVE |
| 66 | ACCUMULATOR |
| 67 | |
| 68 | NEEDLE VALVE |
| 69 | |
| 70 | SPIGOT |
| 71 | |
| 72 | |
| 73 | |
| 74 | |
| 75 | FLEXIBLE DIAPHRAGM |
| 76 | |
| 77 | |
| 78 | |
| 79 | |
| 80 | |
| 81 | |
| 82 | |
| 83 | |
| 84 | |
| 85 | |
| 86 | |
| 87 | |
| 88 | |
| 89 | |
| 90 | |
| 91 | |
| 92 | |
| 93 | |
| 94 | |
| 95 | |
| 96 | |
| 97 | |
| 98 | |
| 99 | |
| 100 | |
| 101 | |

What is claimed is:

1. Apparatus for dispensing a fluid including a super absorbent polymer admixed with water in a building installation including a sprinkler system comprising a plurality of sprinkler heads fed by a plurality of pipes separately carrying super absorbent polymer and water for spraying a target area, comprising, a plurality of super absorbent polymer conduits pipes positioned closely adjacent to plurality of water conduit pipes carrying water;

means on each sprinkler head for receiving pressurized super absorbent polymer at the sprinkler head for admixing with the water discharged therefrom;

means on at least one of said plurality of sprinkler heads for activating the water spray attributable to an elevated temperature;

whereby, upon activation the pressurized super absorbent polymer is admixed with the water at the at least one of said plurality of sprinkler heads, and directed to the target area for further combating combustion.

2. In the apparatus according to claim 1, a needled valve secured to each of said plurality of sprinkler heads for incrementally varying the amount of flow for delivering the super absorbent polymer to each of the plurality of sprinkler heads; whereby each of the plurality of sprinkler heads can be adjusted for line loss to thereby effectively create the same super absorbent polymer dispersal on each of said plurality of sprinkler heads which may be in the building installation.

3. For use in the apparatus according to claim 1, an accumulator;

said accumulator having a fluid container;

a flexible diaphragm interiorly of and totally dividing said container into two volumetric areas for fluids;

means for loading super absorbent polymer into the lower portion of said container; and providing means for flowing water under normal line pressure to the opposite side of said diaphragm from the polymer, whereby the subject accumulator utilizes line water pressure to pressurize the supply of super absorbent polymer in the container for delivering the same to the plurality of super absorbent polymer conduits for delivering the super absorbent polymer to the nozzle.

4. For use in the apparatus according to claim 1, valve means in series with the plurality of super absorbent polymer conduit pipes for delivering the super absorbent polymer to the plurality of sprinkler heads for increasing or decreasing the flow rate of the super absorbent polymer throughout the building installation to each of the plurality of sprinkler heads.

5. Apparatus for dispensing a super absorbent polymer for admixture at a sprinkler head with a nozzle with fluid directed at a fire site comprising, in combination, a plurality of conduits for water and super absorbent polymers, respectively;

one or more sprinkler heads in fluid communication with said conduits for dispensing a mixture of water and super absorbent polymer;

a connection to each of the plurality of water and super absorbent polymer conduits for admixture at the one or more sprinkler heads just prior to release from the one or more sprinkler heads;

means for pressurizing the water and the super absorbent polymer; whereby the super absorbent polymer is mixed with the water under controlled pressure conditions at each of the one or more sprinkler heads for prompt delivery thereafter to the fire site.

6. In the apparatus according to claim 5, a needle valve secured to one or more sprinkler heads for incrementally varying the amount of flow the pipes for delivering the super absorbent polymer to the one or more sprinkler heads; whereby each of one or more sprinkler heads can be adjusted for line loss to thereby effectively create the same super absorbent polymer dispersal on each of the one or more sprinkler heads which may be in the building installation.

7. For use in the apparatus for dispensing a super absorbent polymer according to claim 5, an accumulator;

said accumulator having a fluid container;

a flexible diaphragm interiorly of and totally dividing said container into two volumetric areas for fluids;

means for loading super absorbent polymer into the lower portion of said container; and providing means for flowing water under normal line pressure to the side of the diaphragm opposite that containing the super absorbent polymer;

whereby the subject accumulator utilizes line water pressure to pressurize the supply of super absorbent polymer for delivering the same to each of the plurality of super absorbent polymer conduits for delivery of the super absorbent polymer to the one or more sprinkler heads.

* * * * *